US006700104B2

(12) United States Patent
Bass

(10) Patent No.: US 6,700,104 B2
(45) Date of Patent: Mar. 2, 2004

(54) PORTABLE STRIPPING HEAD INDUCTION HEATING SYSTEM FOR STRIPPING COATED AND LINED METAL OBJECTS AND SURFACES AND METHODS FOR STRIPPING COATED METAL OBJECTS AND SURFACES

(76) Inventor: Raymond Bass, 9539 N. Garden Dr., Beaumont, TX (US) 77705

( * ) Notice: Subject to any disclaimer, the term of this patent is extended or adjusted under 35 U.S.C. 154(b) by 0 days.

(21) Appl. No.: 10/072,828

(22) Filed: Feb. 8, 2002

(65) Prior Publication Data

US 2003/0150852 A1 Aug. 14, 2003

(51) Int. Cl.[7] ..... H05B 6/10

(52) U.S. Cl. ..... 219/635; 219/633; 219/660; 219/672; 29/402.11; 29/402.21; 156/344; 134/38

(58) Field of Search ..... 219/635, 603, 219/634, 633, 660, 661, 670, 672, 676; 134/1, 17, 38; 29/402.01, 402.11, 402.21; 156/344, 584

(56) References Cited

U.S. PATENT DOCUMENTS

| | | | | | |
|---|---|---|---|---|---|
| 3,238,346 | A | * | 3/1966 | Savko | 219/635 |
| 3,403,240 | A | * | 9/1968 | Henderson et al. | 219/635 |
| 4,521,659 | A | * | 6/1985 | Buckley et al. | 219/635 |
| 5,414,247 | A | * | 5/1995 | Geithman et al. | 219/633 |
| 5,660,753 | A | * | 8/1997 | Lingnau | 219/635 |
| 6,211,498 | B1 | * | 4/2001 | Patridge et al. | 219/660 |

* cited by examiner

*Primary Examiner*—Philip H. Leung
(74) *Attorney, Agent, or Firm*—David G. Henry

(57) ABSTRACT

The invention is of a portable stripping head induction heating system and associated method of use thereof which system and method is useful in heating metallic components to which protective coatings or linings are applied for enabling their easy removal.

1 Claim, 2 Drawing Sheets

PORTABLE STRIPPING HEAD INDUCTION HEATING SYSTEM FOR STRIPPING COATED AND LINED METAL OBJECTS AND SURFACES AND METHODS FOR STRIPPING COATED METAL OBJECTS AND SURFACES

BACKGROUND OF THE INVENTION

1. Field of the Invention

The present invention relates to electromagnetic apparatuses and processes which utilize or effect induction heating.

2. Background Information

Many industrial components and vessels are coated, painted or protectively encapsulated for somehow preventing chemical or environmental damage to physical assets, or, in some cases, to enable the items to perform their intended function.

A particularly pertinent example of a coated item which relates to the present invention is that of a rubber-lined railroad tank car, or similarly lined tank trailer for tractor trailer use and storage tanks. Caustic chemicals cannot be stored, shipped or transferred using bare metal components or containers. Therefore, metal tanks and railroad tank cars as are used to maintain or convey such chemicals are coated with thick layers of rubber and rubber-like protective materials. The same treatment is given pipes and fittings as are used in connection with transferring caustics to and from containers and conveyances.

As effective as rubber linings and coatings are in protecting the metal of the above-referenced metal items, the coatings' service life is limited. Degradation over time, as well as physical damage (nicks, tears, etc.) require replacing the coatings, if the underlying metal is to be adequately protected. Ordinarily, such coatings cannot be patched or otherwise repaired, and the existing coating must be completely removed and replaced with a completely new coating.

Removing existing coatings from industrial coated parts is very time consuming and expensive. Preliminary tests involving the removal of approximately ⅓ of the rubber lining of a conventional railroad tank car consumed only 16 hours of labor using the system of the present invention. Conversely, this same process consumed approximately 55 worker hours when using conventional methods. In addition to time parameters, the present methods for removing such linings each present serious health and/or environmental issues. Further still, by so reducing time consumption for such major jobs as railroad tank car stripping, workers are freed to work on other projects (only one worker can strip a railcar tank in two working days, versus the usual three or four workers needed to turn around the job within normal time parameters.

One present method for removing such linings is by burning the lining through use of blow torches, which produces toxic fumes and emissions. Another method involves simply chiseling the lining away with associated worker risks, and enormous time consumption. Certain chemicals can be used to dissolve or disengage rubber linings, but this also produces toxic byproducts, and are hazardous to users, both in terms of vapors and direct physical contact. Still other methods (applicable in most cases only to small components) include hydroblasting components or freezing the components (a small fitting, etc.) and hammering the then-brittle coating to break it free.

Hydroblasting involves maintenance intensive equipment, and hammering or chiseling tends to damage many components, including by gouging metal which cannot, before substantial repair, be again exposed to caustic chemicals.

It would be highly beneficial to industries involved in the use, manufacture or repair of coated metallic structures and devices to provide an apparatus and associated methodology for quickly and safely removing coatings from such structures and devices. Such a device and method would ideally be applicable to the removal of chemical-resistant rubber coatings, as well as to the removal of paints and even labeling materials.

SUMMARY OF THE INVENTION

It is an object of the present invention to provide an apparatus for more quickly removing protective coatings and linings from metallic structures than is presently, economically feasible.

It is another object of the present invention to provide an apparatus for quickly disengaging protective coatings and linings from metallic structures.

It is another object of the present invention to provide an apparatus for quickly disengaging protective coatings and linings from metallic structures, without the use of chemical agents, open flames, or physical impacting.

It is another object of the present invention to provide a method for quickly disengaging protective coatings and linings from metallic structures for easy removal, which method involves inductive heating.

It is another object of the present invention to provide a method for quickly disengaging protective coatings and linings from metallic structures for easy removal, which method obviates the need for chemical stripping agents, open flames, and physical impacting of the structures in removing such coatings or linings.

It is another object of the present invention to provide a portable induction heating apparatus which is useful in disengaging protective coatings and linings from metallic structures for easy removal.

In satisfaction of the above objects, the present invention provides a portable stripping head induction heating apparatus and associated method of use thereof which apparatus and method is useful in heating metallic components to which protective coatings or linings are applied for enabling their easy removal. The apparatus as described herein has use in situations where conventional induction furnaces would have no possible use, in many cases, because the item to be "stripped" cannot be placed within an induction oven. The portability of the stripping head portion of the system described herein enables the use of induction heating for coatings and linings removal in contexts never before realized or practiced in the relevant industries.

Through use of the presently described apparatus and associated methods, the present inventor has successfully reduced the worker hours to strip approximately ⅓ of a railroad tank car from over 50 hours to 16 hours. Small metal fittings which required two hours or more to hand strip have been stripped in six minutes using the present Inventor's apparatus and method. Comparable reductions and worker hours have been realized in stripping operations of other metallic, coated or lined items or surfaces.

The cost savings alone from use of the present invention by the chemical industry (chemical transporters in particular) will easily exceeds millions of dollars each year.

In addition, workers who use the present method and equipment in lieu of chemical, open flame, or physical impact methods will be spared health and safety hazards.

The present equipment and methods may be simple, but they are certainly not obvious, else industry would already be enjoying the astounding benefits.

DETAILED DESCRIPTION OF THE PREFERRED EMBODIMENT

The present invention includes methods for stripping protective coatings or linings from metallic items or surfaces as well as the systems which are assembled for carrying out such methods.

The present portable stripping head induction heating system may be assembled from components which are readily available from electrical equipment and supply distributors. Actual assembly of the system, however, should be performed by persons well familiar with safety concerns when dealing with high voltage and amperage electricity.

The present inventor has endeavored to provide what is now believed to be the preferred embodiment and best mode of the present invention, however, due to the simplicity of the assembled system, many variations and/or substitutions with respect to individual components may be made, while still practicing the present invention. A description of the presently believed preferred embodiment follows.

Figure 1:
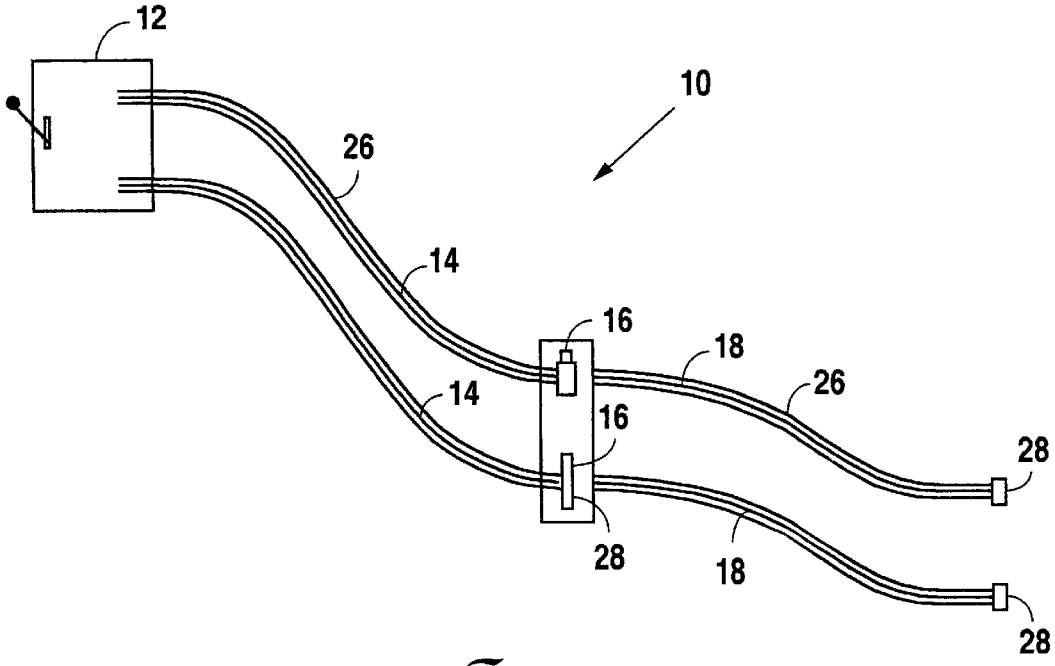
FIG. 1 is a perspective view of the general configuration of an induction heating stripping system of the present invention (less the stripping head portion) and includes the electrical power supply, the primary electrical leads, the capacitors, and the secondary leads.

Referring to FIG. 1, the basic components of the portable stripping head induction heating system 10 of the present invention include: (1) a power supply 12; (2) primary leads 14; (3) capacitors 16; (4) secondary leads 18; and (5) stripping heads or coils (20, 22, or 24 as will be described hereafter).

For safety and cooling purposes, primary leads 14, secondary leads 18, and the conducting rod or cable which form the coils in stripping heads 20, 22, or 24, are all, in the preferred embodiment, enveloped in nonconductive water hoselike tubing 26, and water it is forced through the tubing 26 during use of the system 10 to cool all electrically conducting elements. Water flows into one "side" of the system, circulates all the way to the distal end of the coil in each stripping head, and returns to near the origin in the other side of the system, carrying excess heat with it. In alternative embodiments (if the stripping head does not receive water cooling, or is cooled separately from the leads' coolant supply), primary and secondary leads lie within coolant conduits, and either the coolant (water, usually) exits near the juncture between the primary lead and the stripping head, or flows from one to the other secondary lead in a bypass conduit (not shown in the drawings).

The respective junctions between leads 14 and 18 with capacitors 16 and with stripping heads 20, 22, or 24 are ideally achieved through use of compression fittings 28 which are soldered or brazed onto the leads (cable). Tubing 26 is then clamped onto fittings 28 using suitable clamps (not separately shown in the drawings) for achieving a liquid seal between the tubing 26 and the fitting 28. Of course, tubing 26 includes such inlet and outlet orifices or valves as are appropriate to the desired coolant flow circuit, depending on those portions of system 10 which are to be liquid cooled.

The power supply 12 chosen for the preferred embodiment of the present invention is presently a 75 kW, 10 kHz frequency, 480 volt unit. The capacitors are 450 KVAR (10,000 cycles per second) which are encapsulated in a nonconductive plastic box.

Leads 14 and 18 are, in the preferred embodiment, constructed of #2 copper wire rope. Primary leads 14, in the presently preferred embodiment, are 80 feet in length, while secondary leads 18 are 20 feet in length. Of course, any electrically conductive material can be used in substitution for the copper herein prescribed, provided such conducts sufficiently well conduct (as in the case of the leads) and to exhibit the magnetic coil characteristics while under power (as in the case of the coils in the stripping heads), substantially as would the copper materials assembled as described herein.

The two capacitors to 16 intervene the primary and secondary leads 14 and 18 and provide the current dynamics which generate the magnetic fields necessary to induce the metallic heating as is a primary focus of the present invention.

Figure 2:
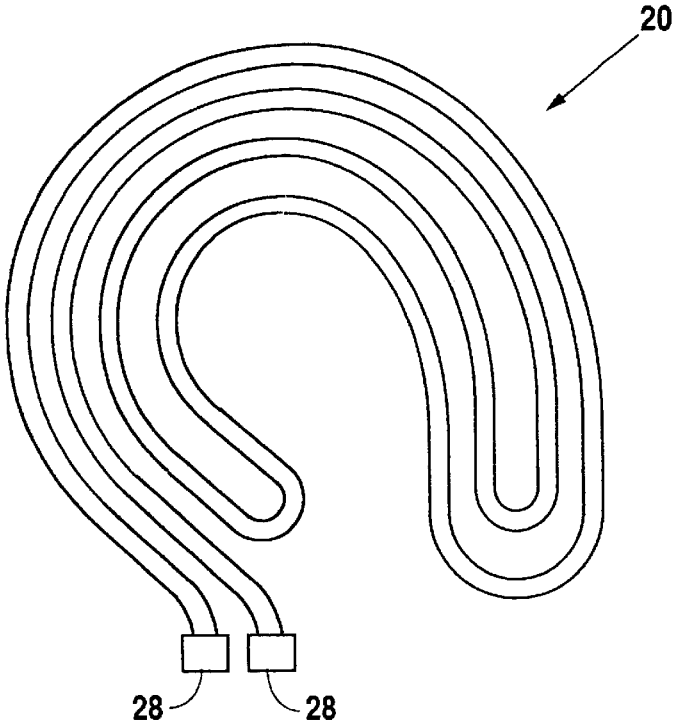
FIG. 2 is a perspective view of a loose coil configuration for a stripping head for use in the present invention.

Three primary stripping head configurations have been conceived and successfully tested to date. Referring to FIG. 2, stripping head 20 merely comprises a 10 foot length of #2 copper wire rope (encapsulated in more tubing 26, in the preferred embodiment) which can be merely wrapped around or placed on that which is to be stripped. As with all junctures between stripping heads and secondary leads 18 in a preferred embodiment of the present invention, compression fittings 28 provide the juncture between stripping head 20 and secondary leads 18.

Figure 3:
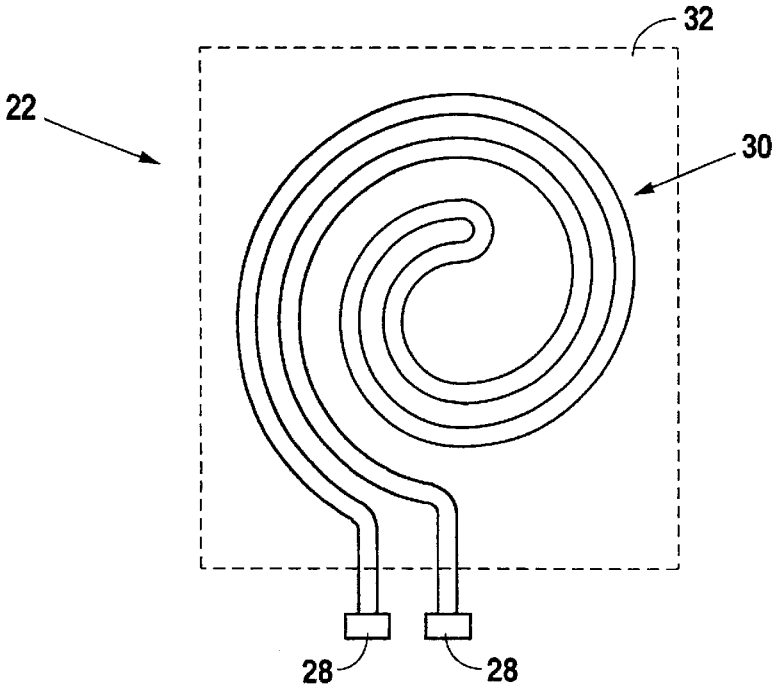
FIG. 3 is a perspective view of a rigid coil configuration for a stripping head for use in the present invention, which coil is configured of round copper tubing and includes concentrator material for focusing the induction energy upon the to-be-stripped, coated or lined surface or item.

Referring to FIG. 3, stripping head 22 is configured into a rigid coil structure and is constructed of ⅜ inch copper tubing which is 10 feet in length. The copper tubing of stripping head 22 is encapsulated by rubber, plastic, or fiberglass to insulate adjoining lengths of tubing from each other and to mechanically and electrically isolate the tubing from that which is being stripped. The back face 30 of stripping head 22 (the face away from that which faces the to-be-stripped item or surface) is overlain by a sheet of concentrator material 32 which is available from electrical supply and induction companies. The concentrator material 32 helps direct the induction energy toward the desired target and is a familiar material in the induction heating field.

Figure 4:
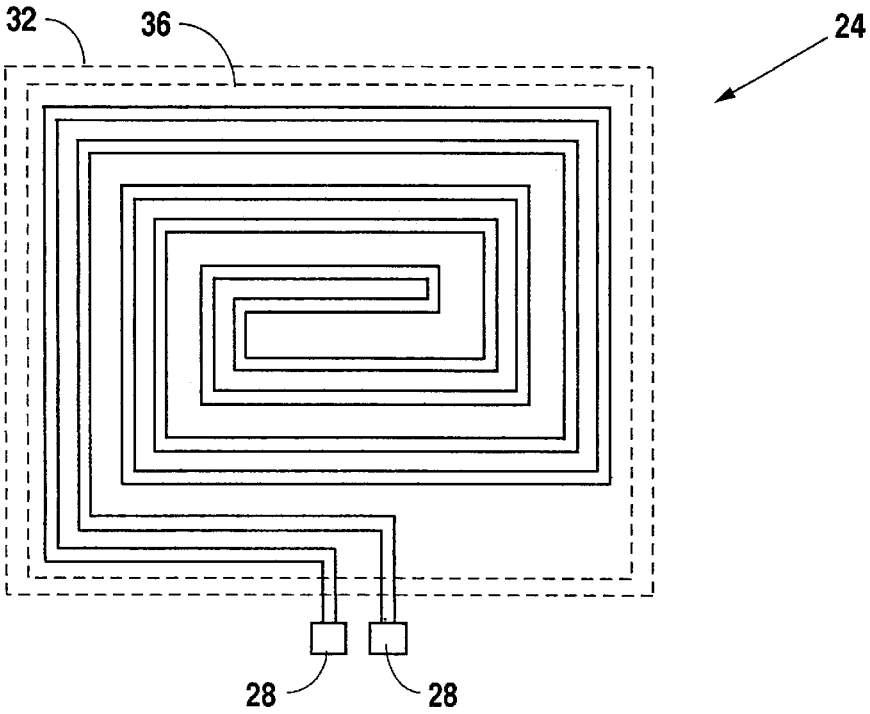
FIG. 4 is a perspective view of a rigid coil configuration for a stripping head for use in the present invention, which coil is configured of flat with a copper tubing and includes concentrator material for focusing the induction energy upon the to-be-stripped, coated or lined surface or item.

Referring to FIG. 4, stripping head 24 is somewhat similar in concept to stripping head 22, however, the copper tubing for stripping head 24 is ⅜ inch square tubing, rather than round tubing as in stripping head 22. Experimentation has shown that use of such square tubing effects a much more efficient focusing of the induction energy toward a to-be-stripped surface or item than can be achieved when using round tubing, thus heating of a to-be-stripped item or surface occurs much more quickly when using this configuration. As with stripping head 22, stripping head 24 includes a sheet of concentrator material 32 which overlies the back face of the head, and a sheet of fiberglass or other insulative/protective material overlays the front face of stripping head 24.

A tremendous advantage which is realized through use of any system of the present invention is that the item or surface which is to be stripped need not be one which can be placed inside of a conventional induction oven. Rather, a stripping head suitable for the particular stripping project can be maneuvered into just about any space and juxtaposed to just about any surface which is to be stripped. The to-be-stripped item or surface need not be enclosed nor juxtaposed with massively sized equipment. This makes induction-based stripping possible in contexts never before conceived as possible, and will enable certain industries (the caustic chemical transport industry, and particular) to save many hundreds of thousands (or millions) of dollars and man-hours each year by rapidly accelerating the process of removing worn or damaged protective coatings or linings. As mentioned earlier, replacing currently used stripping methods with those made possible by the present invention also yields safety and health dividends for workers, employers, and insurers.

Use of any system 10 according to the present invention is straightforward. One merely insures that the stripping system 10 is properly assembled with fittings secured and coolant flowing through the tubing 26, activates power supply 12, and juxtaposed his the selected stripping head 20, 22, or 24 to the item or surface to be stripped. Once the item or surface has heated to a sufficient degree that the to-be-stripped material releases or sloughs off to the desired degree, the stripping head is removed and the system shut down. In the case of a large to-be-stripped surface (such as that of a rubber-lined rail car or tank truck) one cyclically passes stripping heads 22 or 24 (preferably 24) over segments of the surface much as if one were ironing a garment. This process continues until the entire lining has been sufficiently loosened.

It should be emphasized that, however simple the equipment design taught herein may be, the use of such equipment in certain contexts mentioned before yields staggering benefits. For example, stripping a rubber-lined rail car, tank truck or storage tank through use of the present equipment and method, rather than through use of the presently used methods of burning, chiseling, or chemically stripping the lining away have already been proven by the present inventor to dramatically reduce the required time for a stripping operation and to reduce exposure of workers to deleterious substances or conditions.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A method for stripping rubber-like linings from chemical transport tank cars and trailers and from chemical storage tanks comprising the steps of:

selecting an induction heating system comprising:
- an electrical power supply;
- first electrical lead means electrically attached to said electrical power supply, said first electrical lead means for conducting electrical power from said electrical power supply to capacitor means;
- capacitor means electrically connected to said first electrical lead means;
- secondary lead means electrically connected to said capacitor means, said secondary lead means for conducting electrical currents to or from said capacitor means;
- stripping head means including an electrically conductive coil member electrically connected to said secondary lead means;

actuating said electrical power supply;

juxtaposing said stripping head means to a first portion of the lining of a tank car or tank to which is adhered a to-be-removed coating or protective lining;

maintaining said stripping head means in juxtaposition with said first portion for a time sufficient to heat a corresponding first portion of the underlying metal of said tank car or tank to loosen said coating or protective lining therefrom;

juxtaposing said stripping head means to a second portion of the lining of a tank car or tank to which is adhered a to-be-removed coating or protective lining; and maintaining said stripping head means in juxtaposition with said second portion for a time sufficient to heat a corresponding second portion of the underlying metal of said tank car or tank to loosen said coating or protective lining therefrom.

* * * * *